US009078073B2

(12) United States Patent
Goll et al.

(10) Patent No.: US 9,078,073 B2
(45) Date of Patent: Jul. 7, 2015

(54) HEARING AID AND METHOD FOR ELIMINATING ACOUSTIC FEEDBACK IN THE AMPLIFICATION OF ACOUSTIC SIGNALS

(75) Inventors: Erich Goll, Boeblingen (DE); Ernst Dalhoff, Rottenburg (DE); Hans-Peter Zenner, Tuebingen (DE)

(73) Assignee: Eberhard-Karls-Universitaet Tuebingen Universitaetsklinikum, Tuebingen (DE)

( * ) Notice: Subject to any disclaimer, the term of this patent is extended or adjusted under 35 U.S.C. 154(b) by 0 days.

(21) Appl. No.: 14/130,674

(22) PCT Filed: Jul. 4, 2012

(86) PCT No.: PCT/EP2012/062999

§ 371 (c)(1), (2), (4) Date: Mar. 21, 2014

(87) PCT Pub. No.: WO2013/004733

PCT Pub. Date: Jan. 10, 2013

(65) Prior Publication Data

US 2014/0193010 A1 Jul. 10, 2014

(30) Foreign Application Priority Data

Jul. 4, 2011 (DE) ..... 10 2011 106 634

(51) Int. Cl.
*H04R 25/00* (2006.01)

(52) U.S. Cl.
CPC ..... *H04R 25/453* (2013.01); *H04R 25/45* (2013.01); *H04R 25/50* (2013.01); *H04R 2225/43* (2013.01); *H04R 25/70* (2013.01)

(58) Field of Classification Search
CPC ..... H04R 3/02; H04R 25/70; H04R 25/45; H04R 25/453; H04R 25/305; H04R 25/40; H04R 25/50; H04R 2225/41; H04R 2225/43
USPC ..... 381/58, 60, 312, 317, 318, 320, 321, 381/83, 93, 107, 108
See application file for complete search history.

(56) References Cited

U.S. PATENT DOCUMENTS 5,402,496 A 3/1995 Soli et al.
6,347,148 B1 2/2002 Brennan et al.

(Continued)

FOREIGN PATENT DOCUMENTS

EP 1737270 12/2006
EP 2071873 6/2009

OTHER PUBLICATIONS

International Preliminary Report on Patentability and Written Opinion (translation) for PCT/EP2012/062999, issued Jan. 7, 2014, 11 pages.

(Continued)

*Primary Examiner* — Huyen D Le
(74) *Attorney, Agent, or Firm* — Morrison & Foerster LLP

(57) ABSTRACT

In a hearing aid having a microphone to be arranged at a body of a user for capturing ambient sound, a loudspeaker for outputting the ambient sound after having been amplified on a frequency-dependent basis, and a signal processor, the signal processor is configured to amplify the sound such that the amplified sound is audible to the user, and to automatically re-adjust the gain by the following steps: selecting a tone having a specific frequency; outputting the tone and the amplified ambient sound via the loudspeaker as an output sound; capturing via said microphone an analysis sound composed of ambient sound and of a reflection of said output sound; extracting a reflection of the tone from the captured analysis sound; and determining a reflection component for the specific frequency of the tone; adjusting the gain in frequency-specific manner and based on the determined reflection component.

15 Claims, 4 Drawing Sheets

(56) References Cited

U.S. PATENT DOCUMENTS

| | | | | |
|---|---|---|---|---|
| 6,831,986 | B2 * | 12/2004 | Kates | 381/312 |
| 2003/0161492 | A1 | 8/2003 | Miller et al. | |
| 2006/0285709 | A1 | 12/2006 | Barthel | |

OTHER PUBLICATIONS

International Search Report (translation) for PCT/EP2012/062999, mailed Sep. 17, 2012, 2 pages.

* cited by examiner

HEARING AID AND METHOD FOR ELIMINATING ACOUSTIC FEEDBACK IN THE AMPLIFICATION OF ACOUSTIC SIGNALS

CROSS-REFERENCE TO RELATED APPLICATIONS

This application is the national phase of PCT application PCT/EP 2012/062999 having an international filing date of Jul. 4, 2012, which claims priority to German Patent Application No. 10 2011 106 634.2, filed on Jul. 4, 2011. The entire contents of the above-listed applications are incorporated herein by this reference in their entireties.

The present invention relates to a method for setting a gain for a hearing aid that has a sensor element (e.g. microphone) that can be arranged on the outside or in the inside of a body of a user, a transmission element (e.g. loudspeaker) and a signal processor. The invention also relates to a computer-readable storage medium that has commands that prompt a signal processor to carry out the method according to the invention. Furthermore, the invention relates to a hearing aid having a corresponding signal processor.

In conventional hearing aids, the problem of acoustic feedback occurs when acoustic (input) signals are amplified because a portion of the amplified (output) signal reaches the microphone again, is amplified a second time and is then output, reaches the microphone again, is amplified again, and so on. When the gain exceeds a critical value, the system escalates ever further and characteristic whistling or squealing is produced. This critical gain value is different for different frequencies and is dependent on the feedback path. The feedback path is a distance that the amplified signal covers from the loudspeaker to the microphone. In the case of non-implanted, external hearing aids, this distance usually corresponds to at least a portion of the outer ear or of the auditory canal. For external hearing aids, the frequency for which the maximum possible gain is minimized is in the region of 2-4 kHz, for example. This frequency range is very important for comprehensibility of speech, however.

At present, various methods of feedback suppression are used. By way of example, it is possible to reduce the gain for high frequencies. This simply makes the signal quieter in the high-frequency range.

Further methods involve the use of static or dynamic notch filters, in the case of which particularly the frequencies around a resonant frequency for the feedback system are attenuated to a greater extent.

Other methods involve the use of phase cancellation or else temporary frequency shifting in order to interrupt the feedback path.

EP 1 737 270 discloses a method for feedback suppression in a hearing aid. The method first of all involves a test signal being emitted by means of an output transducer in the hearing aid. A response signal arising from the emitted test signal is then captured and evaluated. Finally, this response signal is taken as a basis for setting parameters of a feedback reduction device. The test signals are information signals that can be perceived by the user, such as the announcement of times of day, appointments, etc. While the test signal is emitted, the normal signal path through the hearing aid is preferably interrupted or at least greatly attenuated.

A fundamental disadvantage of all of the conventional methods cited above is that the acoustic input signal is permanently or intermittently distorted by the feedback suppression.

It is the object of the present invention to prevent feedback over the entire audible frequency range without influencing perception of the acoustic input signal, while at the same time distinctly increasing the maximum attainable gain at all frequencies.

This object is achieved by a method for setting a frequency-dependent gain for a hearing aid comprising a sensor element, particularly a microphone, which can be arranged on the outside and/or in the inside of a body of a user, for capturing ambient sound, a transmission element, particularly a loudspeaker, for the ambient sound amplified on a frequency-basis, a signal-processing processor, a data memory and an energy store, wherein the signal processor is configured to amplify the captured ambient sound so that it is audible to the impaired-hearing user of the hearing aid and to automatically re-adjust the gain in a frequency-dependent manner comprising the following steps: selecting a tone at a specific frequency; supplying the tone via the transmission element; capturing an analysis sound, which comprises the ambient sound, if existent, and a reflection of an output sound being output via the transmission element, by means of the sensor element; extracting a reflection of the supplied tone from the captured analysis sound; determining a reflection component for the specific frequency of the tone; and adjusting the gain in a frequency-specific manner on the basis of the so-determined reflection component.

It goes without saying that instead of the reflection component it is also possible to measure an equivalent variable, such as the reflectance R or the like, in order to bring about the effect required by the invention.

A few measurements of the reflection component can be used to calculate an appropriate curve that applies to all frequencies. When the frequency-dependent reflection component curve is known, it can be used to directly infer the frequency-dependent pass gain g, which is in turn a measure of a maximum possible gain.

Since a new updated curve is available within a few seconds each time, the gain of the hearing aid can be customized in real time and on the basis of situation. The hearing aid of the invention is capable of reacting quickly and reliably to a change in the situation (e.g. movement of the hand to the ear of the user) without the occurrence of annoying whistling or squealing. This is all possible while the possible gain is always chosen to be at a maximum. The gain is thus optimized on the basis of the situation.

In one preferred embodiment, the tone is supplied at a volume that is chosen such that the impaired-hearing user does not hear the supplied tone.

Since impaired-hearing users hear less well than healthy users, it is possible to make use of this physical disadvantage by choosing the volume of the (test) tones in a manner that is so user-dependent and frequency-dependent that the user is not disturbed by the additionally supplied test tones. Ideally, the user thus does not perceive the additionally supplied tones at all. This is possible because the test tones can be recognized electronically much better and more clearly than is possible with human hearing—which in this case is also damaged. The volume of the test tones can be set such that the amplitudes of the test tones are maximized within the region that is inaudible to the user. This results in a higher signal-to-noise ratio for the test tones and hence in faster and more exact ascertainment of the response of the feedback path.

It is also advantageous if the method steps are performed continuously and repeatedly for a plurality of discrete tones (in a group) at different specific frequencies, specifically preferably at intervals of one second.

These discrete tones can be used to calculate the frequency-dependent reflection component curve in any frequency ranges within an extremely short time. Since the (test) tones are preferably inaudible to the user, the method steps can be carried out as often as desired and in arbitrarily short succession without disturbing the user of the hearing aid.

In a further particular embodiment, in a very first, nonrecurrent step an initial reflection component curve is determined for the audible spectrum in order to determine discrete points in the frequency spectrum which have associated tones which are, preferably recurrently, supplied for the purpose of an update for an instantaneous reflection component curve.

In other words, this means that, when determining the reflection component curve, particularly significant or characteristic points in the curve profile are selected (e.g. extreme points and inflection points) that are particularly suited to the arithmetic determination of a current curve by means of interpolation.

It is also advantageous if an updated instantaneous reflection component curve is determined on the basis of numerical curve adaptation.

The computation capacity of processors today is so high that even relatively complex and extensive calculations can be performed within an extremely short time. This also applies to the method according to the invention. The invention involves the use of microprocessors, for example, in order to perform these calculations quickly and reliably.

Furthermore, it may be advantageous if the specific frequencies of discrete points differ by less than 3 Hz.

With a frequency difference of 3 Hz, human hearing is no longer capable of distinguishing the tones from one another. The user hears just one tone, if any. This reduces his subjective disturbance, provided that he hears it in the first place.

It is also advantageous if a resolution of signal processing by the signal processor is selected to be higher than the resolution of human hearing, as a result of which the specific frequencies of each tone can be separated.

The aforementioned object is also achieved by a computer-readable storage medium that has commands that prompt a signal processor to carry out the method according to the invention.

In addition, the aforementioned object is achieved by a hearing aid having a sensor element, a transmission element and a signal processor that is set up to prompt the performance of the method according to the invention.

It goes without saying that the features cited above and those yet to be explained below can be used not only in the respectively indicated combination but also in other combinations or on their own without departing from the scope of the present invention.

Exemplary embodiments of the invention are shown in the drawing and are explained in more detail in the description below. In the drawing.

Figure 1A:
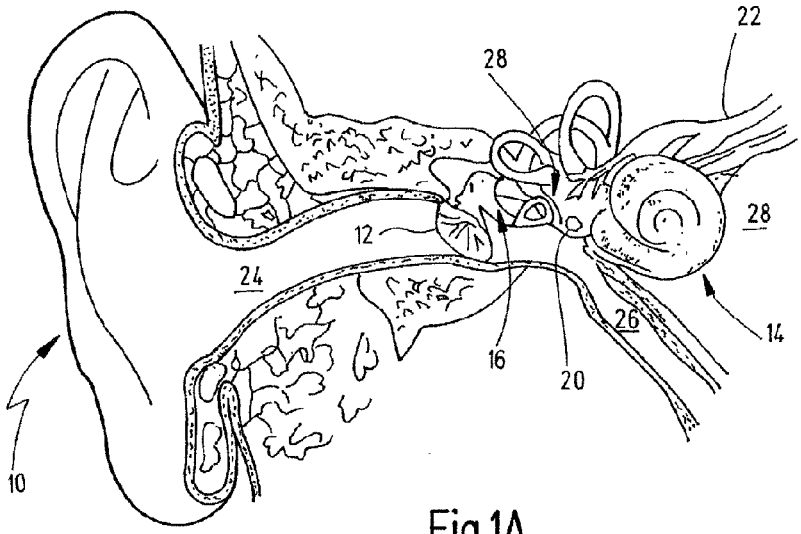
FIG. 1A shows a schematic illustration of a human ear.

FIG. 1A shows a schematic and to some extent sectional illustration of a human ear 10 of a normally hearing person. Signals (tones and sound) are focused by the pinna and routed along the auditory canal in the direction of the eardrum 12. The signals hits the eardrum 12 and are transmitted into the cochlea 14 via a system of bones 16 (ossicular chain) that act as levers in order to allow amplification and acoustic customization transformation to suit a stamp or a membrane 18, called the "oval window". The cochlea 14 is a spirally wound tube similar to a snail shell that, in the bent state, is approximately 35 mm long and that is divided over the greatest portion of its entire length by a partition, called the "basilar membrane". A lower chamber of the cochlea is called the "scala tympani" and an upper chamber is called the "scala vestibuli". The cochlea 14 is filled with a fluid (perilymph) having a viscosity that corresponds approximately to the viscosity of water. The scala tympani is equipped with a further membrane 20, called the "round window", which is used to take up the displacement of the fluid when the oval window 18 is deflected.

When the oval window 18 is acoustically manipulated via the ossicles 16, the basilar membrane is displaced in corresponding fashion and vibrates as a result of the movement of the fluid in the cochlea. The displacement of the basilar membrane stimulates hair cells (sensory cells) that are situated in a particular structure on the basilar membrane (not shown). Movements by these sensory hairs produce electrical discharges in fibers of the auditory nerve 22, specifically as a result of the mediation of cells of the spiral ganglion that are positioned in the modiolus wall or modiolar wall.

The human ear 10 can be coarsely divided into three regions, namely an outer ear 24, a middle ear 26 and an inner ear 28.

Pressure from the ossicles 16 on the oval window 18 runs as a vibration up the scala vestibuli to the tip of the cochlea 14 and via a cochlear hole (not shown) along the scala tympani back down to the round window 20, which can equalize the recorded pressure through extension or vibration.

Figure 1B:
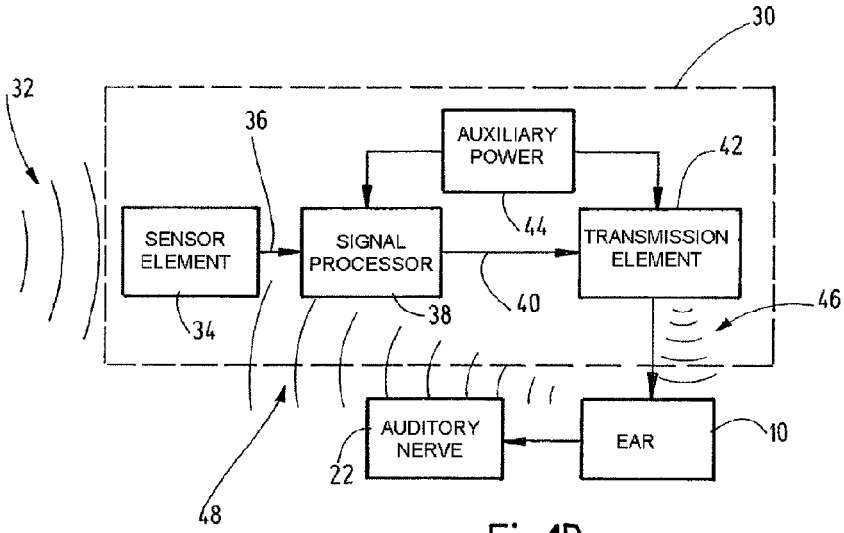
FIG. 1B shows a block diagram of a hearing aid.

FIG. 1B illustrates a highly simplified block diagram of a hearing system or hearing aid 30. Some of the system components shown are common to almost all hearing aids. Ambient signals 32 (sound and tones) are picked up by means of a sensor element 34 (e.g. a microphone). Electrical (input) signals 36 that are produced in the process are forwarded to a (sound) signal processor or signal-processing processor 38. There, they are processed and converted into electrical signals 40 that a transmission element 42 can forward in the form of amplified output sound 46 to the ear 10 or the auditory nerve 22. The signal processing and signal transmission require power from an energy source 44, which can be provided by a storage battery, for example. Depending on whether all the components of the hearing aid 30 are arranged in or on the cranium of the patient, reference is made to full implants, partial implants or external devices. In the case of full implants, all the components are integrated in the head of the patient. The present invention can be applied to all variants. However, it is preferred for as many conventional and known components as possible to be used. In this way, it is possible to ensure comprehensive technical provision and support. By way of example, it is thus conceivable for known sensor elements and signal processors to be used that have already successfully undergone appropriate clinical studies. The present development is concerned essentially with the signal handling and amplification by means of the signal processor 38.

The inventors have recognized that (recurrent) measurement of a reflection component (equivalent to reflection coefficient or reflection factor) that is dependent on the specific feedback path (particularly the auditory canal of a user) can prevent (acoustic) feedback in the entire audible frequency range without influencing the perception of the acoustic input signal (ambient sound). At the same time, a maximum attainable gain at all frequencies is distinctly increased.

Reflectance R, which is often also called reflectivity or degree of reflection, is the ratio between a reflected intensity and an incident intensity as an energy variable, e.g. in the case of sound waves (sound pressure, sound field variable). This involves disturbed propagation of the waves. The reflectance can be determined according to the following equation GL1:

$$R=Pr/P0 \quad \text{GL1}$$

where R is the reflectance, Pr is the reflected power and P0 is the incident power.

Reflectance is generally also understood to mean scattered reflection of a variable, for example of diffuse reflection of light on a rough, nonreflective surface.

An upper limit for a total gain G of the hearing aid 30 that is achieved as a result of multiple amplifier passes is given by equation GL2:

$$G=g/(1-rg) \quad \text{GL2}$$

where g is the pass gain for an amplifier pass and r is the reflection component of a sound wave that returns from the transmission element 42 (cf. FIG. 1B) to the sensor element 34. In addition, equation GL3 applies in this regard:

$$rg<1. \quad \text{GL3}$$

For the inverse relation, equation GL4 applies:

$$g=1/(1+rG). \quad \text{GL4}$$

If the product of the reflection and the pass gain is greater than or equal to 1 ($r\,g\geq 1$), the total gain G diverges. Such divergence corresponds to a resonance catastrophe (whistling in the hearing aid). It is necessary to avoid this. It is therefore not a trivial matter to set the pass gain g such that a stable total gain G is achieved, since the reflection component r can change on the basis of external parameters such that the total gain G falls sharply (e.g. when r falls) or rises beyond all measure (for rising r). By way of example, just the hand of the user physically touching his ear can be regarded as an external parameter. In this case, there may be noticeable deformation of the auditory canal that results in a change in the (acoustic) feedback path.

The inventors have recognized that it is advantageous to determine the frequency-dependent reflection component r(f) continuously and recurrently (that is to say periodically). If the frequency-dependent reflection component r is known with sufficient precision at any time and the pass gain g is automatically re-adjusted on the basis of this knowledge, a distinctly higher (stable) total gain G is possible. For this purpose, the reflection component r is measured in the course of operation of the hearing aid 30, specifically for a plurality of discrete frequencies or frequency channels. This multiple channel measurement allows interpolation of the frequency profile of the reflection component r(f).

Figure 2:
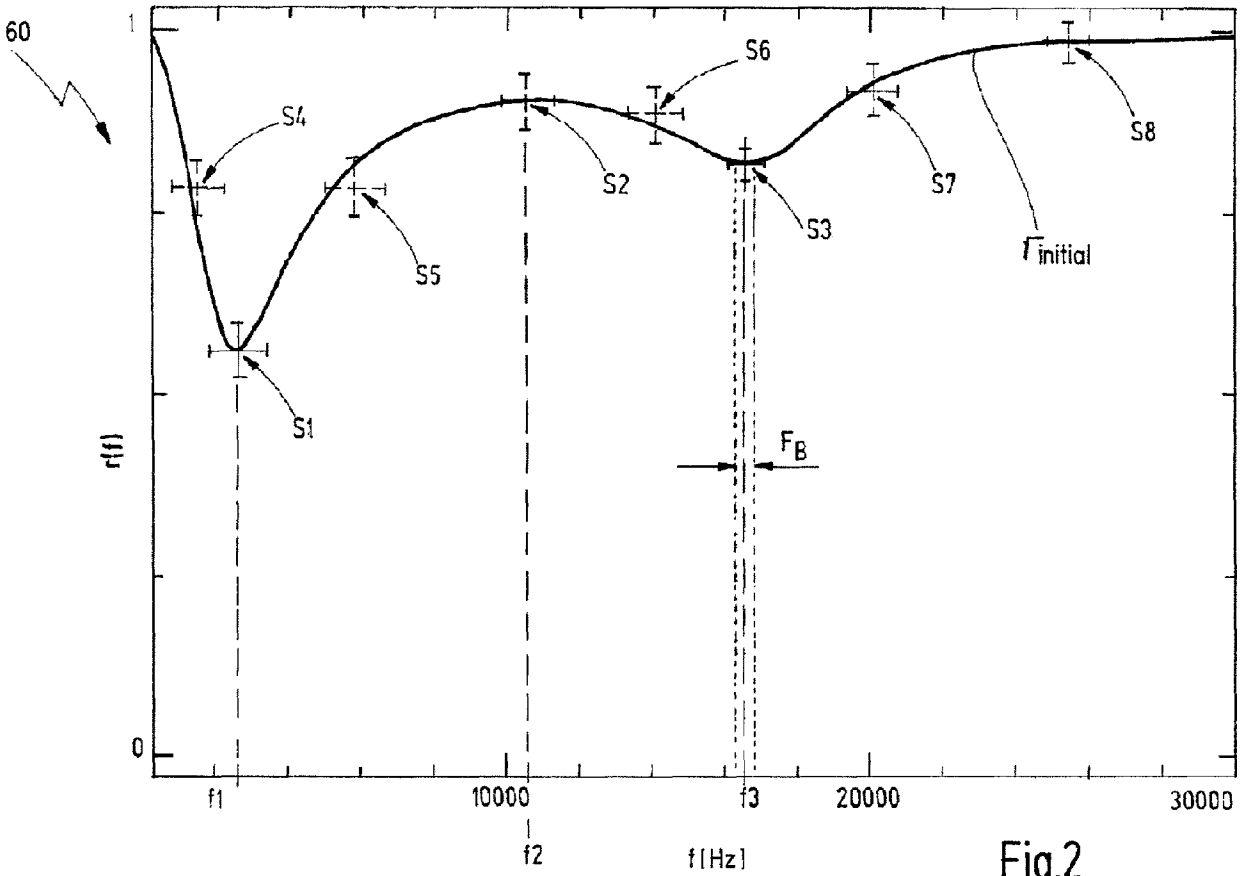
FIG. 2 shows a graph of a reflectance curve.

FIG. 2 shows a frequency-dependent profile for the reflection component r(f) as a graph 60. According to equation GL5, the reflectance R corresponds to the square of the reflection component r:

$$R=r^2 \quad \text{GL5}$$

The reflectance R is a variable that is equivalent to the reflection component r. The reflection component r is plotted over the audible frequency spectrum (in this case from 0 to 30 kHz by way of example). The reflection component r can assume values between 0% and 100%. If the reflection component r is 100%, the signal is reflected completely. If the reflection component r is 0%, the signal is absorbed and/or passed completely (absorption and/or transmission).

The graph 60 in FIG. 2 shows an original reflection component curve $r_{initial}$ that is determined, preferably under laboratory conditions, in a very first step. By way of example, the reflection component curve $r_{initial}$ is measured when the hearing aid is first put on. The profile of the reflection component curve $r_{initial}$ is dependent firstly on the instantaneous shape of the auditory canal of the user and secondly on technical parameters of the hearing aid 30. The reflection component curve $r_{initial}$ has a different appearance for each user. Just replacing one component of the hearing aid 30, such as using a different sensor element 34, particularly a different microphone, or a different transmission element 42, particularly a different loudspeaker, can alter the (otherwise characteristic) profile of the original reflection component curve $r_{initial}$.

The original reflection component curve $r_{initial}$ can be used in order to select discrete points S that are suitable for later interpolation. FIG. 2 shows eight discrete points S1-S8 by way of example. The first three discrete points S1-S3 are situated at extreme points. The discrete points S1 and S3 are situated at minima. The discrete point S2 is situated at a maximum between the minima. The discrete points S4-S7 are situated in the region of inflection points. The discrete point S8 is situated at a freely selectable upper limit for high frequencies f.

Each discrete point Si corresponds to a discrete specific frequency fi. In order to be able to track a change in the reflection component r over time, a few discrete points Si are selected, usually between 10 and 20 discrete points Si, that preferably represent characteristic points on the curve profile, and then the associated discrete reflection factor r(fi) is determined, for example every 3 to 5 s.

Returning to FIG. 2, it is thus possible to determine the discrete frequency-dependent reflection components r(fi) for the exemplary eight discrete points S1-S8 shown or for the frequencies f1-f8 associated therewith. The discrete points can be determined simultaneously or successively, in which case the actual order is unimportant. In order to determine a discrete frequency-dependent reflection factor, the transmission element 42 (cf. FIG. 1B) can be used to output a tone at this specific frequency fi. This tone or the reflection thereof in the auditory canal is captured using the sensor element 34. Ideally, i.e. when no ambient sound 32 is existent, the reflection factor r can be determined directly from an intensity of the reflection signal 48.

Figure 3:
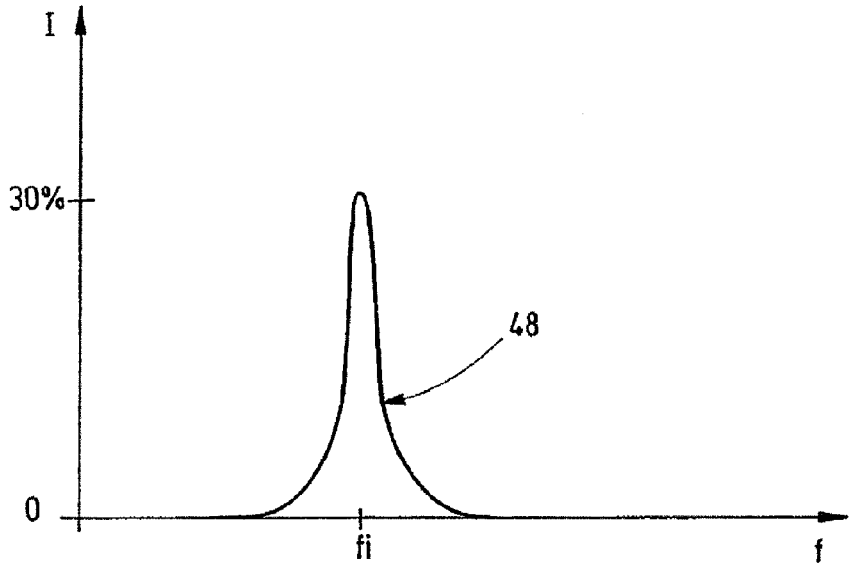
FIG. 3 shows an intensity distribution for a tone reflected under ideal conditions.

FIG. 3 shows an intensity distribution—shown in idealized form—for the reflection signal 48 at a specific frequency fi, as captured by the sensor element 34 when no ambient sound 32 is existent. The intensity I of the reflection signal 48 is normalized in FIG. 3 to an intensity of the output signal or output sound 46 (cf. FIG. 1B). It goes without saying that the reflection signal or reflection sound 48 has the ambient sound 32 overlaid on it in practice, as a result of which the test tone needs to be extracted from the actually captured sound (analysis sound) by means of filtering, calculation, etc. This means that the extracted test tone is no longer present in the signal forwarded to the amplifier. Preferably, a continuous test tone is therefore sent, since the noise component can then be kept small as a result of exact-band filtering at the transmission frequency. The more exact-band the filtering, the longer an integration time and hence also a reaction time in response to changes in the reflection component or reflection coefficient. It is recommended that a suitable compromise be chosen in this case.

Returning to FIG. 2, an actual instantaneous profile for the reflection factor curve can be calculated, specifically for any desired frequency from the audible spectrum, by means of interpolation, particularly when the original reflection factor curve $r_{initial}$ is known. This instantaneous reflection factor curve can be used to optimize the frequency-dependent gain g. The pass gain g can be customized on the basis of frequency, as a result of which the undesirable whistling or squealing is prevented completely, despite maximum possible gain.

Figure 4:
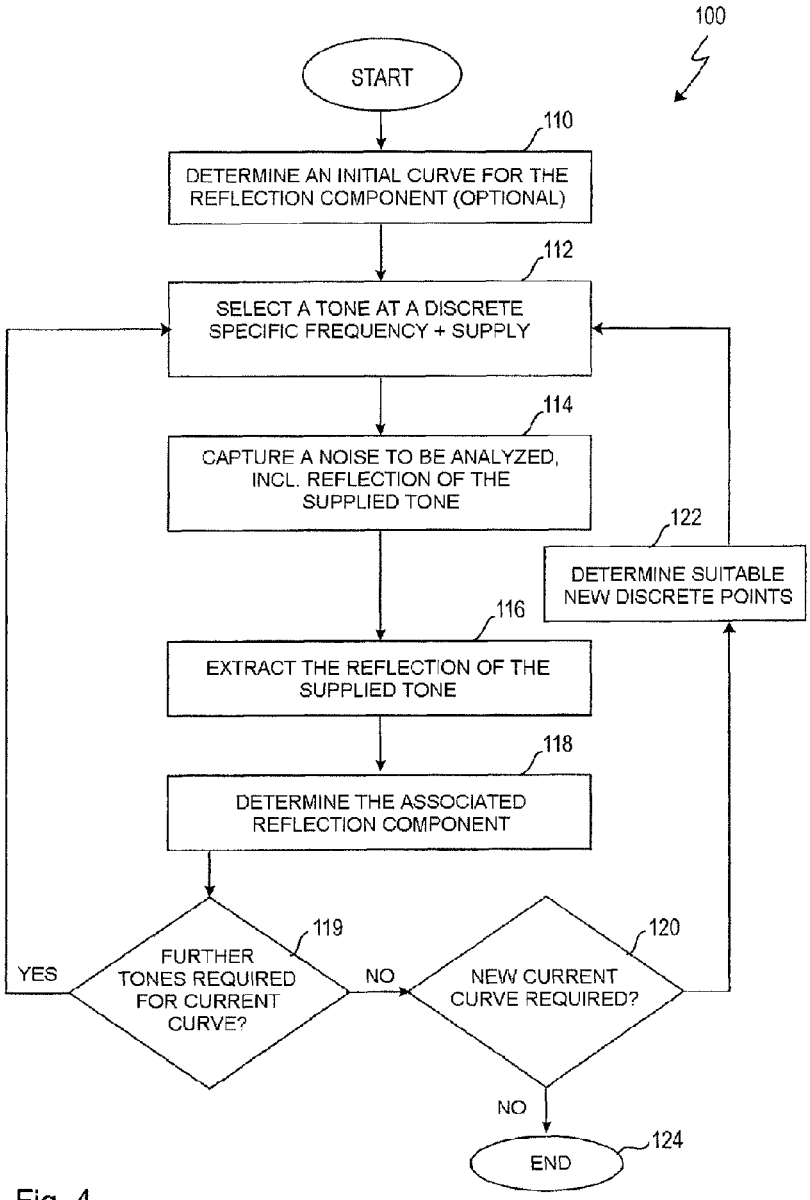
FIG. 4 shows a flowchart for a method according to the invention.

With reference to FIG. 4, a flowchart for a method 100 according to the invention is shown. The method 100 has a plurality of steps 110 to 124.

In a first optional step 110, an initial reflection component curve (cf. FIG. 2) can be determined. The initial reflection component curve assists the calculation of an updated curve and simplifies the determination of discrete points Si for the interpolation of the curve through the use of electronic computation units, such as by using the signal processor 38 in FIG. 1B, which uses a data memory (not shown) to store a program that contains commands for performing the method 100 of the invention.

When the discrete points Si have been determined, it is possible for corresponding discrete tones to be supplied—preferably simultaneously—as shown in step 112. Alternatively, the tones can also be supplied successively. The determination of the discrete points Si is a way of selecting a tone at a discrete specific frequency fi. It goes without saying that the tones at their specific frequencies fi can also be selected in a different way. By way of example, it is thus possible, as an alternative, to supply tones at firmly prescribed frequency intervals without taking account of the profile of the curve. However, it is advantageous if the tones are chosen such that the profile of the reflection component curve can be determined in the simplest mathematical way possible—and hence quickly in terms of data processing.

In a further step 114, the sensor unit 34 (cf. FIG. 1B) is used to capture a sound that is to be analyzed. This analysis sound ideally corresponds (exclusively) to a reflection of the tone supplied in step 112. The ideal case presupposes that otherwise no further ambient sound is existent. In practice, this will be different. In practice, an ambient sound 32 will be existent that is overlaid on the reflection of the supplied tone.

Optionally, an ambient sound can be suppressed, for example by means of filters, or eliminated by means of computation. This is possible particularly when the frequency of the reflected tone is known.

In a step S118, the reflection component of the reflected tone at the specific frequency is determined. This reflection component can be used to calculate a reflection component curve that is valid for all frequencies. From this value, it is also possible to determine the pass gain g at the specific frequency fi directly. The pass gains g(f) for other frequencies can be determined from the reflection component curve r(f).

In an optional step 119, it is possible to test whether further tones are required for an updated reflection component curve. If further tones (discrete points at specific discrete frequencies) are required, the process returns to step 112. If no further tones are required in step 119, a step 120 can be used to test whether a new updated reflection component curve is needed. If a new curve is needed, suitable new discrete points can be determined on the basis of the current curve in an optional step 122. Subsequently, the process returns to step 112 and the method just described starts afresh. The process is repeated continuously, with the customization of the gain possibly being able to resort to a moving average.

If a new updated curve is not needed in the test 120, the method ends in a step 124, e.g. when the hearing aid 30 switches off.

The invention claimed is:

1. A method for setting a frequency-dependent gain in a hearing aid, said hearing aid comprising:

a sensor element configured to be arranged at a body of a hearing-impaired user and to capture ambient sound, a signal processor configured to amplify said captured ambient sound with said frequency-dependent gain such that said amplified captured sound is audible to the hearing-impaired user, said signal processor being further configured for automatic re-adjusting of the frequency-dependent gain, a transmission element for outputting said amplified captured ambient sound, a data memory, and an energy store, said automatic re-adjusting of said frequency-dependent gain comprising the following steps:

selecting a tone at a specific frequency;

outputting the tone and, if existent, said amplified captured ambient sound during ordinary operation mode of said hearing aid via said transmission element to produce an output sound;

capturing an analysis sound, which comprises said ambient sound, if existent, and a reflection of said output sound, by means of the sensor element;

extracting a reflection of the supplied tone from the captured analysis sound;

determining a reflection component for the specific frequency of the tone; and adjusting the gain in a frequency-specific manner on the basis of the so-determined reflection component.

2. The method of claim 1, wherein said sensor element comprises a microphone.

3. The method of claim 1, wherein said transmission element is a loudspeaker.

4. The method as claimed in claim 1, wherein the tone is supplied at a volume that is chosen such that the impaired-hearing user does not hear the supplied tone.

5. The method as claimed in claim 1, wherein the method steps are performed continuously and repeatedly for a plurality of discrete tones at different specific frequencies.

6. The method as claimed in claim 5, wherein the method steps are performed continuously and repeatedly at intervals of one second.

7. The method as claimed in claims 1, wherein in a very first non-recurrent step an initial reflection component curve is determined for the audible spectrum in order to determine discrete points in the frequency spectrum which have associated tones which are outputted via said transmission element for the purpose of producing an instantaneous reflection component curve.

8. The method as claimed in claims 7, wherein said associated tones are recurrently outputted for the purpose of updating said instantaneous reflection component curve.

9. The method as claimed in claim 8, wherein an updated instantaneous reflection component curve is determined on the basis of numerical curve adaptation.

10. The method as claimed in claim 1, which further comprises the step of selecting at least two tones which form a characteristic tone group.

11. The method as claimed in claim 10, wherein said at least two tones are close together.

12. The method as claimed in claim 10, wherein the characteristic tone group consists of precisely two different tones and wherein the specific frequencies of the tones of the characteristic tone group are just so far apart that human hearing can no longer distinguish the associated specific frequencies, which method comprises the following further steps:

simultaneously outputting the two different tones via the transmission element so that beating occurs for human hearing;

capturing the tones by means of said sensor element;

determining the frequency-dependent reflection component for at least one of the two tones of the characteristic tone group; and adapting the gain by means of the reflection components determined in this manner.

13. The method as claimed in claim 10, wherein the specific frequencies of the at least two tones differ by less than 3 Hz.

14. The method as claimed in claim 10, wherein a resolution of signal processing by the signal processor is selected to be higher than the resolution of human hearing so that the specific frequencies of each of the at least two different tones are separable.

15. A method for setting a frequency-dependent gain in a hearing aid, said hearing aid comprising:

a sensor element configured to be arranged at a body of a hearing-impaired user and to capture ambient sound, a signal processor configured to amplify said captured ambient sound with said frequency-dependent gain such that said amplified captured sound is audible to the hearing-impaired user, said signal processor being further configured for automatic re-adjusting of the frequency-dependent gain, a transmission element for outputting said amplified captured ambient sound, a data memory, and an energy store, said automatic re-adjusting of said frequency-dependent gain comprising the following steps:

selecting at least two tones which form a characteristic tone group, each of said at least two tones having a specific frequency, wherein the specific frequencies of said at least two tones differ by less than 3 Hz;

outputting said at least two tones and, if existent, said amplified captured ambient sound via said transmission element to produce an output sound;

capturing an analysis sound, which comprises said ambient sound, if existent, and a reflection of said output sound, by means of the sensor element;

extracting a reflection of the supplied tone from the captured analysis sound;

determining a reflection component for the specific frequency of each of said at least two tones; and adjusting the gain in a frequency-specific manner on the basis of the so-determined reflection component.

* * * * *